US010176772B2

(12) United States Patent
Sun et al.

(10) Patent No.: US 10,176,772 B2
(45) Date of Patent: Jan. 8, 2019

(54) DISPLAY DEVICE HAVING AN ARRAY SUBSTRATE

(71) Applicants: BOE Technology Group Co., Ltd., Beijing (CN); Beijing BOE Display Technology Co., Ltd., Beijing (CN)

(72) Inventors: Zhihua Sun, Beijing (CN); Liang Zhang, Beijing (CN); Yizhen Xu, Beijing (CN); Baoyu Liu, Beijing (CN); Shulin Yao, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 32 days.

(21) Appl. No.: 14/472,581

(22) Filed: Aug. 29, 2014

(65) Prior Publication Data

US 2015/0379950 A1 Dec. 31, 2015

(30) Foreign Application Priority Data

Jun. 27, 2014 (CN) ..... 2014 1 0302201

(51) Int. Cl.
*G09G 3/36* (2006.01)

(52) U.S. Cl.
CPC ... *G09G 3/3614* (2013.01); *G09G 2300/0426* (2013.01); *G09G 2300/0452* (2013.01)

(58) Field of Classification Search
CPC ..... G09G 3/3614; G09G 3/3648; G09G 2300/0426; G09G 3/3607; G09G 3/3688
USPC ..... 345/87, 88, 92, 96, 98, 690
See application file for complete search history.

(56) References Cited

U.S. PATENT DOCUMENTS 6,335,719 B1 * 1/2002 An ..... G09G 3/3614 345/96
6,538,631 B1 * 3/2003 Kwon ..... G09G 3/2011 345/100
2007/0097146 A1 * 5/2007 Gies ..... G09G 5/02 345/613

(Continued)

FOREIGN PATENT DOCUMENTS

CN 103558720 A 2/2014

OTHER PUBLICATIONS

First Office Action for Chinese Patent Application No. 201410302201.7, dated Apr. 6, 2016, 8 pages.

*Primary Examiner* — Koosha Sharifi-Tafreshi
(74) *Attorney, Agent, or Firm* — Westman, Champlin & Koehler, P.A.

(57) ABSTRACT

The present disclosure provides an array substrate, a display device, and a drive method for the display device. The array substrate comprises gate lines and data lines and a plurality of pixel units defined by intersection of the gate lines and the data lines with one another; wherein the plurality of pixel units is divided into a number of pixel regions each of which includes at least one column of the pixel units and is driven by a data line driving unit; wherein, first and second data lines are disposed side by side between two adjacent pixel units that are respectively located at the margins of any two adjacent pixel regions; and, one of the first and the second data lines is connected with the pixel units adjacent thereto and located in odd rows while the other is connected with the pixel units adjacent thereto and located in even rows.

10 Claims, 4 Drawing Sheets

(56) References Cited

U.S. PATENT DOCUMENTS

| | | | | |
|---|---|---|---|---|
| 2008/0204434 | A1* | 8/2008 | Lee | G02F 1/1345 345/205 |
| 2011/0007257 | A1* | 1/2011 | Min | G02F 1/136286 349/150 |
| 2011/0032241 | A1* | 2/2011 | Jeong | G09G 3/3614 345/212 |
| 2011/0037746 | A1* | 2/2011 | Kim | G09G 3/3611 345/211 |
| 2011/0134103 | A1* | 6/2011 | Nam | G09G 3/3648 345/212 |
| 2011/0157107 | A1* | 6/2011 | Jo | G02F 1/136286 345/204 |
| 2015/0015623 | A1* | 1/2015 | Yang | G09G 3/3648 345/697 |

* cited by examiner

DISPLAY DEVICE HAVING AN ARRAY SUBSTRATE

CROSS-REFERENCE TO RELATED APPLICATION

This application claims the benefit of Chinese Patent Application No. 201410302201.7 filed on Jun. 27, 2014 in the State Intellectual Property Office of China, the whole disclosure of which is incorporated herein by reference.

BACKGROUND OF THE INVENTION

Field of the Invention

The present invention relates to display technology, and more particularly, to an array substrate, a display device and a drive method for the same.

Description of the Related Art

Thin Film Transistor-Liquid Crystal Display (TFT-LCD) is widely used in these electrical products such as TV, mobile phone and displayer, etc., and dominates in the field of panel display, because it has the advantages of stable quality, realistic picture, elimination of radiation, space saving, and power consumption saving, etc.

Refer to FIG. 1, in the TFT-LCD, there are gate lines and data lines disposed in an array substrate and intersected with one another, and, a plurality of pixel units is defined by the intersected gate lines and data lines. In a row of the pixel units, three neighboring pixel units constitute one pixel. All these pixel units are divided into a number of pixel regions by columns, and, one pixel region is driven by one corresponding data driving unit. As shown in FIG. 1, the data driving units SDn and SDn+1 are connected with their corresponding data lines, respectively. In each column of the pixel units, the two adjacent data lines Dn and Dn+1 are connected alternately in row with the pixel units of the same column, respectively. Each pixel unit includes a thin film transistor which is driven by signal from the gate line, and a pixel electrode driven by signal from the data line. Generally, there is a capacitance effect in the array substrate and a memory capacitor is formed between a common electrode and the pixel electrode. During the charging and discharging of the memory capacitor, due to capacitive coupling, voltage on the common electrode fluctuates. Moreover, polarization of the liquid crystal molecules occurs since the liquid crystal molecules rotates in one direction longtime. Therefore, there requires polarity inversion of the liquid crystal molecules from one frame to another frame.

In the prior art, the drive modes to polarity inversion mainly includes frame inversion, row inversion, column inversion, and, dot inversion, etc.

In a greenish test picture shown in FIG. 2, columns of the pixels in dark and columns of the pixels in bright are alternated in column with one another. In order to achieve polarity inversion in a manner of dot inversion while effectively reducing logical power consumption of the liquid crystal panel, Z inversion is usually used for arrangement of the pixels, and column inversion is usually used for output of the common electrode. However, the abovementioned drive modes for polarity inversion have the disadvantages of: distortion of color will occur during displaying of the liquid crystal panel since voltage difference applied on the pixel electrode changes when the voltage on the common electrode is increased or decreased. Taken the first row of the pixels as an example, in a region where it is in a bright state (contrary to a dark state) after being charged, in each pixel, red pixel unit (R) and blue pixel unit (B) are in positive polarity while green pixel unit (G) is in negative polarity. Because two pixel units are in positive polarity while one pixel unit is in negative polarity when there is data signal from the data lines, voltage on the common electrode fluctuates upwardly, correspondingly, in the whole row of pixels, the voltages on these common electrodes fluctuate upwardly. In one pixel under the bright state, since the red pixel unit (R) and blue pixel unit (B) are in positive polarity, voltages on the corresponding common electrodes fluctuate upwardly, resulting in decreasing the voltage differences on the red pixel unit (R) and on the blue pixel unit (B) and correspondingly lightening the colors on the red pixel unit (R) and blue pixel unit (B); while, since green pixel unit (G) is in negative polarity, voltage on the corresponding common electrode fluctuate upwardly, resulting in increasing the voltage difference on the green pixel unit (G) and correspondingly brightening the color on the green pixel unit (G) due to relative larger rotation offset of the driven liquid crystal molecules caused by the increased the voltage difference. In this way, the green pixel unit (G) is over brightened and the color of the green pixel unit (G) is deepened, which renders this pixel greenish. For similar reasons, these other green pixel units (G) are greenish, and as a result, the displaying of the whole liquid crystal panel is greenish. Such greenish is more serious when voltage on the common electrode fluctuates in a more acute manner.

In order to alleviate such greenish displaying, at present, generally a method for compensating voltage on the common electrode while reducing the memory capacitance is adopted. However, for the liquid crystal panel with high refresh rate, voltage on the common electrode fluctuates acutely, in this case, the effect is not too apparently even if the abovementioned method is adopted. Furthermore, with the development of technology, the liquid crystal panel will have a higher refresh rate, which can be 120 Hz, or even, 240 Hz. Therefore, the greenish displaying becomes the bottleneck for large-size TFT-LCD with high refresh rate recently.

SUMMARY OF THE INVENTION

At least one object of the present invention is to provide an array substrate, which is capable of alleviating greenish phenomenon occurred during displaying of a display device comprising such array substrate.

Another object of the present invention is to provide a display device, which is capable of alleviating greenish phenomenon occurred during displaying of such display device.

Still another object of the present invention is to provide a drive method for a display device, which is capable of reducing greenish phenomenon occurred during displaying of such display device.

According to an embodiment of one aspect of the present invention, there is provided an array substrate, comprising gate lines and data lines and a plurality of pixel units defined by intersection of the gate lines and the data lines with one another; wherein the plurality of pixel units is divided into a number of pixel regions each of which includes at least one column of the pixel units and is driven by a data line driving unit; wherein, a first data line and a second data line are disposed side by side between two adjacent pixel units that are respectively located at the margins of any two adjacent pixel regions; and, one of the first data line and the second data line is connected with the pixel units adjacent thereto and located in odd rows while the other of the first data line and the second data line is connected with the pixel units adjacent thereto and located in even rows.

According to an embodiment of a further aspect of the present invention, there is provided a display device comprising an array substrate according to the abovementioned array substrate and a drive circuit connected to the array substrate; wherein, the drive circuit comprises a plurality of data driving units for driving the pixel units.

According to an embodiment of a still further aspect of the present invention, there is provided a drive method for the abovementioned display device, comprising the steps of:

transmitting a gate scan signal to the gates through the gate lines so as to drive switch-on of a thin film transistor; and providing, by the data driving units, a data signal required to display a frame to pixel electrodes through the data lines connected to the data driving units.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF PREFERRED EMBODIMENTS OF THE INVENTION

Figure 1:
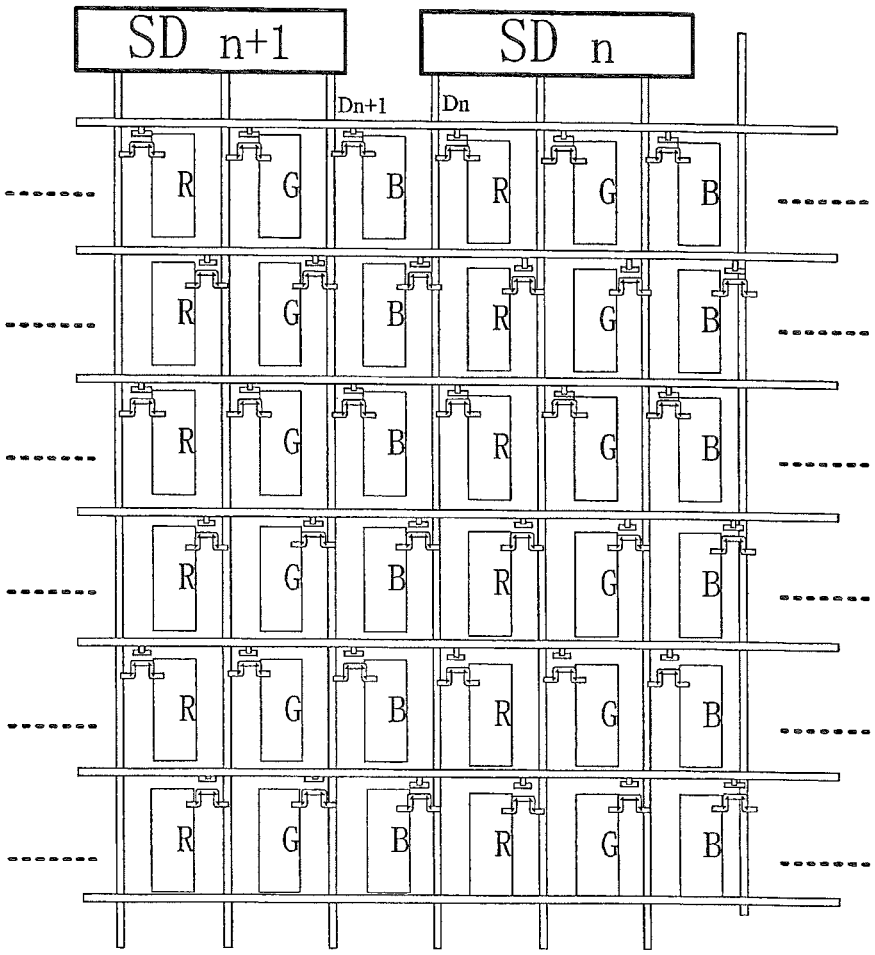
Fig. 1 (PRIOR ART)
FIG. 1 is a schematic diagram of an arrangement of pixels driven by Z inversion in the prior art.
Figure 2:
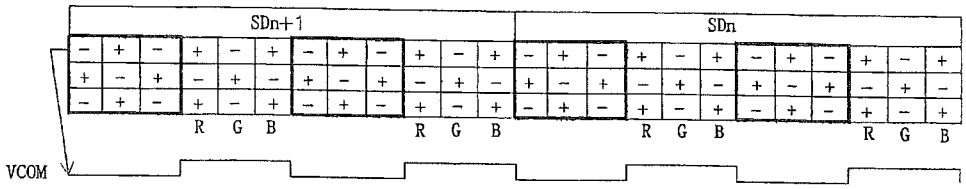
Fig. 2 (PRIOR ART)
FIG. 2 is a schematic diagram of greenish displaying and fluctuation of voltage on the common electrode in FIG. 1.

Exemplary embodiments of the present invention will be described hereinafter in detail with reference to the attached drawings, wherein the like reference numerals refer to the like elements. The present invention may, however, be embodied in many different forms and should not be construed as being limited to the embodiment set forth herein; rather, these embodiments are provided so that the present invention will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In order to alleviate greenish phenomenon in displaying of the display device with higher refresh rate in the prior art, in accordance with a general inventive concept of the present invention, improvements to the data line design on two adjacent pixel units in predefine pixel regions are made. In particular, two data lines (i.e., first data line and second data line, in which "first" and "second" are used for purpose of description without implying importance thereof) are disposed side by side between two adjacent pixel units that are respectively located at the margins of any two adjacent pixel regions. One of the first data line and the second data line is connected with the pixel units adjacent thereto and located in odd rows while the other of the first data line and the second data line is connected with the pixel units adjacent thereto and located in even rows. With the abovementioned data line design, a data signal for the pixel unit is provided by the pixel unit connected with the date line, such that voltages on the common electrodes in the pixel units arranged in the same row but in two adjacent columns of the pixel units are in opposite fluctuation directions to compensate for each other and reduce fluctuations on the voltages, thereby alleviating greenish phenomenon during the displaying and correspondingly improving displaying quality and effect of the display device.

First Embodiment

Figure 4:
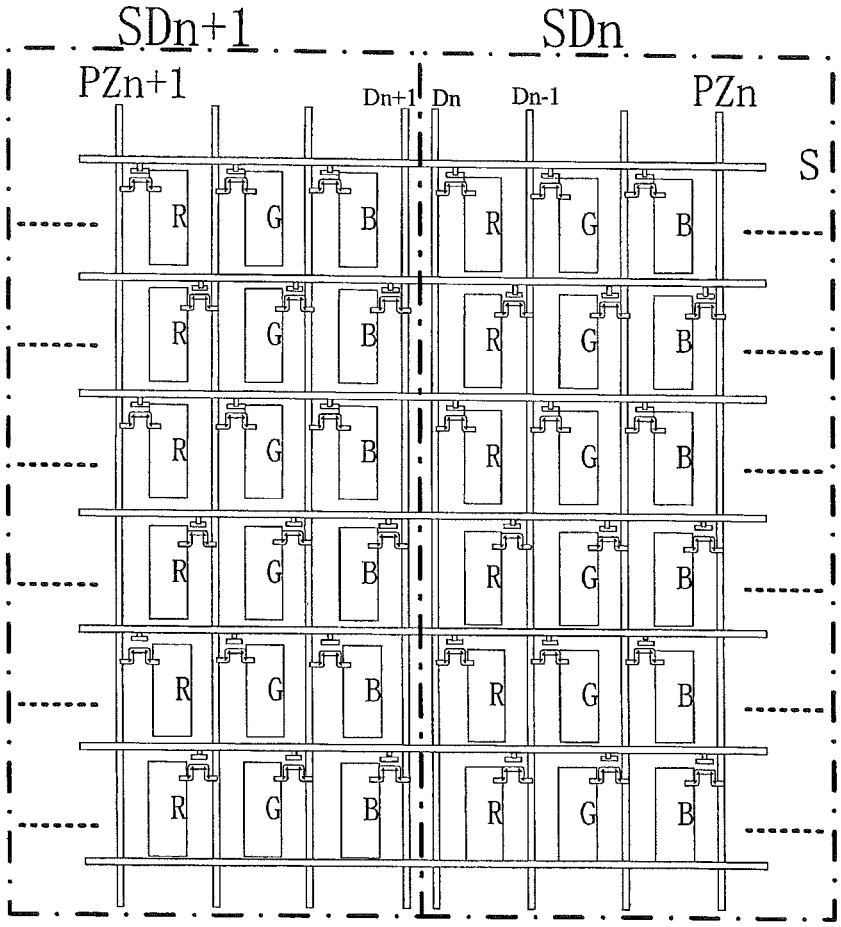
FIG. 4 is a schematic diagram of a pixel arrangement in an array substrate according to an embodiment of the present invention.

Referring to FIG. 4, the present embodiment provides an array substrate comprising gate lines and data lines and a plurality of pixel units defined by intersection of the gate lines and the data lines with one another. The plurality of pixel units is divided into a number of pixel regions. Each of the pixel regions includes at least one column of the pixel units and is driven by one data line driving unit. As shown in FIG. 4, gate lines S, data lines Dn−1, Dn, Dn+1 and two pixel units PZn, PZn+1 defined by intersection of the gate lines S and the data lines Dn−1, Dn, Dn+1 with one another are shown. Each pixel region includes three columns R, G, B of the pixel units. Two pixel units PZn, PZn+1 are configured to correspond to two data driving units SDn, SDn+1, wherein the data driving unit SDn is configured to drive the right pixel unit PZn while the data driving unit SDn+1 is configured to drive the left pixel unit PZn+1.

In one pixel region, another date line (i.e., a third data line) is disposed in the middle of any two adjacent columns of the pixel units, and the another date line (i.e., a third data line) is connected alternately in row with. For example, in the pixel unit PZn corresponding to the data driving unit SDn, two columns R, G of the pixel units are adjacent to each other, the date line Dn−1 (i.e., third data line) is disposed in the middle thereof, and, the third date line Dn−1 is connected alternately in row with the adjacent columns R, G of the pixel units. That is, the third date line Dn−1 is connected to the pixel units G in odd rows and to the pixel units R in even rows.

Among two adjacent pixel regions corresponding to the two data driving units, two data lines (i.e., first data line and second data line) are disposed side by side between two adjacent pixel units. The first data line is connected with the pixel units adjacent thereto and located in odd rows while the second data line is connected with the pixel units adjacent thereto and located in even rows. For example, as shown in FIG. 4, among two adjacent pixel regions PZn, PZn+1 corresponding to the two data driving units SDn, SDn+1, the two data lines (i.e., first data line Dn and second data line Dn+1) are disposed side by side between two adjacent pixel units (that is, the pixel unit B and the pixel unit R). The first data line Dn is connected with the pixel units R in alternate rows while the second data line Dn+1 is connected with the pixel units B located in another alternate rows. That is, the first data line Dn is connected with the pixel units R in odd rows while the second data line Dn+1 is connected with the pixel units B in even rows.

Figure 3:
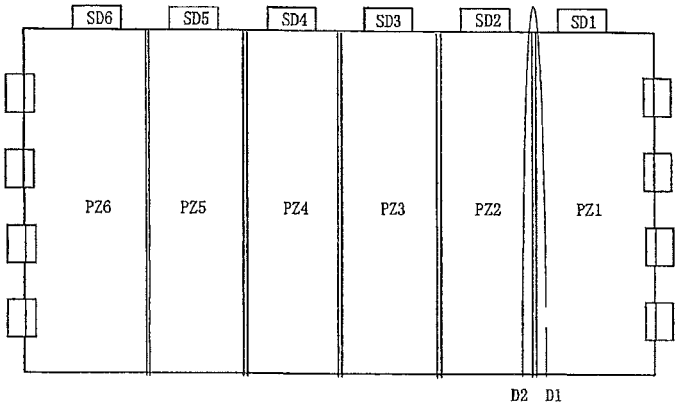
FIG. 3 is a schematic diagram of a display device according to an embodiment of the present invention.

In order to achieve better understanding of the present invention, FIG. 3 shows an array substrate where six pixel regions PZ1, PZ2, PZ3, PZ4, PZ5, PZ6, corresponding respectively to six data driving units SD1, SD2, SD3, SD4, SD5 SD6, are provided. As shown in this Figure, among any two of the six pixel regions, two data lines (for example, D1 and D2 shown in FIG. 3) are arranged between the two adjacent pixel regions. Here, an arrangement where five groups of date lines each comprises two data lines arranged side by side are provided.

In an exemplary embodiment, each pixel region includes the same number of columns of the pixel units. For example, according to the embodiment shown in the figure, each pixel region includes three columns of the pixel units. In this way, the design structure of the array substrate is simplified, which facilitates to simply design of the drive circuit. Moreover, after loading the data signal on the data lines, voltages on the common electrodes corresponding to the respective pixel regions have consistent fluctuations. Meanwhile, in the present embodiment, the pixel units in one row are connected with one gate line S which provides the scan signal to gates of the pixel units in the one row.

According to the embodiments of the present invention, with the array substrate having the abovementioned structure, in one column of the pixel units, the pixel units in odd rows are connected to one data line while the pixel units in even rows are connected to another data line, such that the pixel units in odd rows and the pixel units in even rows are connected respectively to different data lines, to achieve the Z inversion for data signal drive of the pixel units.

Figure 5:
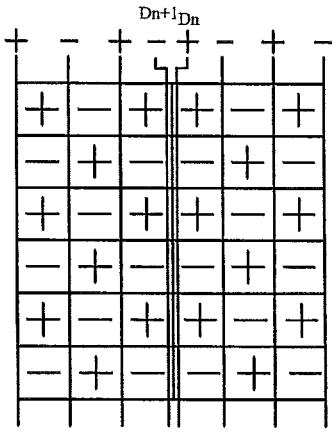
FIG. 5 is a schematic diagram showing polarity inversion of the pixels in the array substrate of FIG. 4.

Accordingly, according to embodiments of the present invention, in the structure of the array substrate shown in FIG. 4, in each pixel region corresponding to one data driving unit, the third data line is disposed in the middle of any two adjacent columns of the pixel units, and is connected alternately in row with one of the two adjacent columns of the pixel units, that is, the pixel units are provided to have Z reversion arrangement. The Z inversion arrangement is one arrangement for pixels, i.e., every data line drives the pixels at the left side and at the right side thereof alternately by row. In other word, the same data line drives the pixels at the left side and located in odd rows but drives the pixels at the right side and located in even rows; or, the same data line drives the pixels at the right side and located in odd rows but drives the pixels at the left side and located in even rows. It is called as Z inversion. With this structure of the array substrate, after applying the data signal on the data lines, the data lines provide the data signals to the pixel units connected with these data lines, and, the data signals applied on the adjacent data lines possess reverse voltage polarities. Distribution of polarities of the pixel units in the pixel regions after being charged is presented in FIG. 5, in which distribution of polarities of the pixel units in two adjacent pixel regions is in a symmetric structure with respect to the two adjacent data lines used as symmetry axis.

Figure 6:
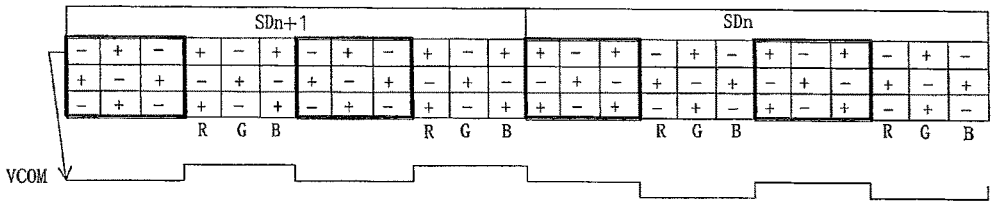
FIG. 6 is a schematic diagram of greenish displaying and fluctuation of voltage on the common electrode in FIG. 4.

In this way, in a greenish test picture shown in FIG. 6, the pixel regions are corresponded to the data driving units SDn and SDn+1. In the pixel region corresponding to the data driving units SDn, the pixel units in the same row have negative and positive polarities arranged alternately, while in the pixel region corresponding to the data driving units SDn+1, the pixel units in the same row have positive and negative polarities arranged alternately, and, two adjacent pixel units in the same row and among the two pixel regions have the same polarities. In this case, taken the first row of the pixels in FIG. 6 as an example, in a pixel region corresponding to the data driving units SDn, polarities of voltages on the pixel electrodes under the bright state are two negative and one positive and the voltages fluctuate downwardly, while in a pixel region corresponding to the data driving units SDn+1, polarities of voltages on the pixel electrodes under the bright state are one negative and two positive and the voltages fluctuate upwardly, thereby, fluctuations of the voltages on the common electrodes in the pixel units in the whole row compensate for each other. In this way, the fluctuations are reduced such that such fluctuations of the voltages on the common electrodes in the pixel units are greatly reduced and the pixel units R, the pixel units G and the pixel units B each has a relatively small voltage difference, and correspondingly, there is no relatively large change in color of the displaying, that is, there is no greenish phenomenon caused by darkening the pixel units G while lightening the pixel units R and the pixel units B.

Therefore, the array substrate according to the embodiment of the present invention can be used in the large-sized TFT-LCD liquid crystal display equipment with a refresh rate of 120 Hz or more. With the data signal driving mode for the pixel electrodes having the Z inversion arrangement and the date outputting mode having the column inversion arrangement, the arrangement of polarity dot inversion in the display is achieved, obtaining a desired display effect and effectively reducing logical power consumption.

Second Embodiment

According to an embodiment of the present invention, there also provides a display device comprising the abovementioned array substrate and a drive circuit connected to the array substrate; wherein, the drive circuit comprises a plurality of data driving units for driving the pixel units.

In an embodiment, the array substrate is divided into P pixel regions and the drive circuit includes P data driving units corresponding to the P pixel regions in an one-to-one relationship. Each of the data driving units is correspondingly connected to the respective data lines in the driven pixel region, wherein P is a positive integer. It should be noted that, the digital voltage is provided by the data driving units in the conventional manner.

Specifically, the drive circuit comprises gate lines and data lines connected with the pixel units of any one pixel region, a gate driving circuit connected to the gate lines, and a source driving circuit connected with data lines of any one pixel region, wherein the gate drive circuit is configured to output a scan signal to the gate lines corresponding to the pixel regions line by line simultaneously and at the same time the source driving circuit is configured to output a data signal to the data lines connected with the source driving circuit. The gate drive circuit comprises a gate drive chip connected to the gate lines corresponding to the pixel regions.

According to an embodiment of the present invention, the display device may be any products or equipments having the display function, such as liquid crystal panel, electronic paper, liquid crystal TV, digital photo frame, mobile phone, tablet PC, etc.

Third Embodiment

According to an embodiment of the present invention, there further provides a drive method for the abovementioned display device comprising steps of: transmitting a gate scan signal to the gates through the gate lines so as to drive switch-on of a thin film transistor; and providing, by the data driving units, a data signal required to display a frame to pixel electrodes through the data lines connected to the data driving units. In this way, according to the present invention, with the conventional date driving mode, voltages of the date signal supplied by the adjacent date lines have reverse polarities. In the pixel regions corresponding to the data driving units SDn and SDn+1 of the array substrate according to an embodiment of the present invention, in the pixel region corresponding to the data driving units SDn, the pixel units in the same row have negative and positive polarities arranged alternately, while in the pixel region corresponding to the data driving units SDn+1, the pixel units in the same row have positive and negative polarities arranged alternately, and, two adjacent pixel units in the same row and among the two pixel regions have the same polarities. In this way, the greenish phenomenon is alleviated or eliminated and thereby the display quality of the display device is improved.

The present invention at least has the advantages of: in the array substrate according to the present invention, two data lines are disposed between two adjacent pixel units that are driven by two data driving units, and every data line is connected with the corresponding column of pixel units alternately by rows such that distribution of polarities of the pixel units in two adjacent pixel regions after being charged is in a symmetric structure with respect to the two adjacent data lines used as symmetry axis and the voltages on the common electrodes in the pixel units arranged in one same row but in two adjacent columns of the pixel units are in opposite fluctuation directions to compensate for each other and reduce fluctuations on the voltages, thereby alleviating greenish phenomenon during the displaying and correspondingly improving displaying quality and effect of the display device.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A display device comprising an array substrate and a drive circuit connected to the array substrate, wherein the array substrate: comprises gate lines and data lines and a plurality of pixel units, and the drive circuit comprises a plurality of data driving units for driving the pixel units;

wherein, the plurality of pixel units is divided into a number of pixel regions each of which includes at least three columns of the pixel units, and in each of which at least one data line is disposed between two adjacent columns of the pixel units;

wherein, a first data line and a second data line are disposed side by side between two adjacent columns of the pixel units that are respectively located at margins of any two adjacent pixel regions, and, one of the two adjacent columns of the pixel units that are respectively located at margins of any two adjacent pixel regions is a column of red pixel units (R) while the other is a column of blue pixel units (B);

wherein the two adjacent pixel regions (PZn and PZn+1) are each configured to correspond to a corresponding one of the plurality of data driving units (SDn and SDn+1) such that a first driving unit (SDn) is configured to drive pixel units in a first, right pixel region (PZn) of the adjacent pixel regions, and a second data driving unit (SDn+1) is configured to drive pixel units in a second, left pixel region (PZn+1) of the adjacent pixel regions; and wherein the first data line and the second data line are directly adjacent to each other without any elements between them and one of the first data line and the second data line is connected with the pixel units adjacent thereto and located in odd rows while the other of the first data line and the second data line is connected with the pixel units adjacent thereto and located in even rows.

2. The display device according to claim 1, wherein, in any one of the pixel regions, a third data line is disposed in the middle of and is connected alternately in row with, any two adjacent columns of the pixel units.

3. The display device according to claim 1, wherein, the pixel regions each includes the same number of columns of the pixel units.

4. The display device according to claim 1, wherein, in any one column of the pixel units, the pixel units in odd rows are connected to one data line while the pixel units in even rows are connected to another data line, such that the pixel units in odd rows and the pixel units in even rows are connected respectively to different data lines.

5. The display device according to claim 1, wherein, the pixel units in one row are connected with one of the gate lines.

6. The display device according to claim 1, wherein, the array substrate is divided into P pixel regions and the drive circuit includes P data driving units corresponding to the P pixel regions in an one-to-one relationship, and, each of the data driving units is correspondingly connected to the respective data lines in the corresponding driven pixel region, wherein P is a positive integer.

7. The display device according to claim 6, wherein, the drive circuit further comprises a gate drive circuit connected to the gate lines, wherein the gate drive circuit inputs a scan signal to gates through the gate lines corresponding to the gate drive circuit and the data driving units input a data signal to the pixel units through the data lines corresponding to the data driving units.

8. The display device according to claim 7, wherein, the gate drive circuit comprises a gate drive chip connected to the gate lines corresponding to the pixel regions.

9. The display device according to claim 1, wherein, two adjacent pixel units in the same row and among any two adjacent pixel regions have the same polarities when the plurality of pixel units are charged.

10. The display device according to claim 2, wherein each data line drives the pixel units positioned on a left side or on a right side thereof respectively, in an manner alternating by row, such that the same data line drives the pixel units located at the left side and located in the odd rows, and drives the pixels at the right side and located in even rows or alternatively the same data line drives the pixels at the right side and located in odd rows and drives the pixels at the left side and located in even rows.

* * * * *